US008500046B2

(12) United States Patent
Gilpatrick et al.

(10) Patent No.: US 8,500,046 B2
(45) Date of Patent: Aug. 6, 2013

(54) TURBULENCE CONTROL ASSEMBLY FOR HIGH PRESSURE CLEANING MACHINE

(75) Inventors: Richard J. Gilpatrick, Whitewater, WI (US); James A. Louden, Cambridge, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 230 days.

(21) Appl. No.: 12/429,028

(22) Filed: Apr. 23, 2009

(65) Prior Publication Data

US 2010/0270402 A1 Oct. 28, 2010

(51) Int. Cl.
*B05B 1/14* (2006.01)
*B05B 9/01* (2006.01)
*F15D 1/02* (2006.01)

(52) U.S. Cl.
USPC ..... 239/590.3; 239/532; 138/37; 138/39

(58) Field of Classification Search
USPC ..... 239/532, 590.5, 526, 594, DIG. 23, 239/590, 590.3; 138/37, 39–41, 44
See application file for complete search history.

(56) References Cited

U.S. PATENT DOCUMENTS

| | | | | | |
|---|---|---|---|---|---|
| 2,578,392 | A | * | 12/1951 | Bendersky et al. | 239/468 |
| 3,620,457 | A | * | 11/1971 | Pearson | 239/589 |
| 3,630,444 | A | * | 12/1971 | Nelson | 239/29 |
| 3,701,482 | A | * | 10/1972 | Sachnik | 239/590.3 |
| 3,811,622 | A | * | 5/1974 | Blatt | 239/526 |
| 3,851,825 | A | * | 12/1974 | Parkison et al. | 239/590.3 |
| 4,795,092 | A | | 1/1989 | Fuller | |
| 4,955,540 | A | | 9/1990 | Fuller et al. | |
| 5,242,119 | A | | 9/1993 | Jariyasunant | |
| 5,404,957 | A | * | 4/1995 | McCormack | 169/70 |
| 5,467,929 | A | | 11/1995 | Bosio | |
| 5,472,145 | A | | 12/1995 | Shannon et al. | |
| 5,762,107 | A | * | 6/1998 | Laws | 138/44 |
| 5,779,099 | A | | 7/1998 | D'Andrade | |
| 6,571,805 | B2 | | 6/2003 | Hoenisch et al. | |
| 6,685,107 | B1 | | 2/2004 | Salzman | |
| 7,083,120 | B2 | | 8/2006 | Gilpatrick et al. | |
| 7,217,053 | B2 | | 5/2007 | Alexander et al. | |
| 7,389,949 | B2 | | 6/2008 | Marchand et al. | |
| 7,472,842 | B2 | | 1/2009 | Gilpatrick et al. | |
| 2003/0052199 | A1 | | 3/2003 | Ikeuchi et al. | |
| 2006/0254008 | A1 | * | 11/2006 | Hahn et al. | 15/50.3 |
| 2006/0255183 | A1 | * | 11/2006 | Burdsall et al. | 239/526 |
| 2007/0125878 | A1 | | 6/2007 | Hahn et al. | |
| 2007/0221746 | A1 | * | 9/2007 | Heinrich et al. | 239/135 |
| 2008/0001007 | A1 | * | 1/2008 | Gilpatrick et al. | 239/310 |
| 2008/0061167 | A1 | | 3/2008 | Gansebom | |
| 2008/0251603 | A1 | | 10/2008 | Monty | |
| 2009/0050716 | A1 | * | 2/2009 | Binder et al. | 239/526 |

* cited by examiner

*Primary Examiner* — Darren W Gorman
(74) *Attorney, Agent, or Firm* — Foley & Lardner LLP

(57) ABSTRACT

An assembly for controlling water turbulence through a high pressure cleaning machine includes a nozzle body, which has an inlet, an outlet, and a flow path. The nozzle body has a fastening end that is designed to couple the nozzle body to a pressure washer, at an end of a spray gun shaft, for example. The nozzle body also includes a plurality of conduits (e.g., an array of tubules) arranged in parallel with each other along the flow path and located between the inlet and the outlet. Additionally the nozzle body may include a screen or screens positioned along the flow path. The plurality of conduits and the screens are designed to reduce a turbulence of a water flowing through the assembly.

20 Claims, 6 Drawing Sheets

TURBULENCE CONTROL ASSEMBLY FOR HIGH PRESSURE CLEANING MACHINE

BACKGROUND

The present invention relates generally to the field of high pressure cleaning machines (e.g., pressure washers). More specifically, the invention relates to nozzle assemblies for pressure washers, wherein the nozzle assemblies are configured to reduce the turbulence of a water flowing through the pressure washers.

Powered pressure washers are known to be used to clean dirt, paint, or mold from pavement, brick face, cement, or other surfaces. To achieve such results, these devices generally provide a high pressure water stream (e.g., approximately 1400 psi) at a modest flow rate (e.g., approximately 1.3 to 1.4 gpm). Heavy duty pressure washers may provide streams with even higher pressures (e.g., 3000 to 5000 psi) at possibly greater flow rates (e.g., approximately 3.5 gpm). The high pressure streams of heavy duty pressure washers facilitate more demanding tasks, such as resurfacing or cutting of materials.

In certain applications, a long traveling distance of a high pressure cleaning machine spray beam is a useful feature, such as during second-story window cleaning from the ground or during gutter cleaning from the top of a stationary ladder. In other applications, high beam strength of a pressure washer spray beam is a useful feature, such as for washing off tree sap or bird residue. However, due to limitations of some pressures washers, spraying beams may not be focused, coherent, or steady upon leaving a spray gun. Instead the spraying beams may have a high degree of turbulence and choppiness, causing beam water to scatter, weakening the beam, reducing water density (and momentum) of the beam, increasing the beam surface area and drag on the beam, and shortening the potential traveling distance of the beam.

SUMMARY

One embodiment of the invention relates to an assembly for controlling water turbulence through a high pressure cleaning machine. The assembly includes a nozzle body, which has an inlet, an outlet, and a flow path. The nozzle body also includes a plurality of conduits (e.g., tubes) arranged in parallel with each other along the flow path and located between the inlet and the outlet. This plurality of conduits is designed to reduce a turbulence of water flowing through the assembly.

Another embodiment of the invention relates to a pressure washer for cleaning applications. The washer includes a motorized water pump for driving a flow of water, and a spray gun designed to spray the flow of water. The spray gun includes a nozzle body and a turbulence control member designed to reduce a turbulence in the flow of water.

Yet another embodiment of the invention relates to a pressure washer spray gun for cleaning applications, which uses a high-powered stream of water for the cleaning. The spray gun includes a housing with a handle and a water duct attached to the housing, where the duct forms a flow path. Additionally, the spray gun includes a controller (e.g., trigger) for operating a valve attached to the duct and positioned in the flow path, where the controller is designed to release the valve. The spray gun also includes a nozzle body attached to the duct, where the nozzle body includes a turbulence control member.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
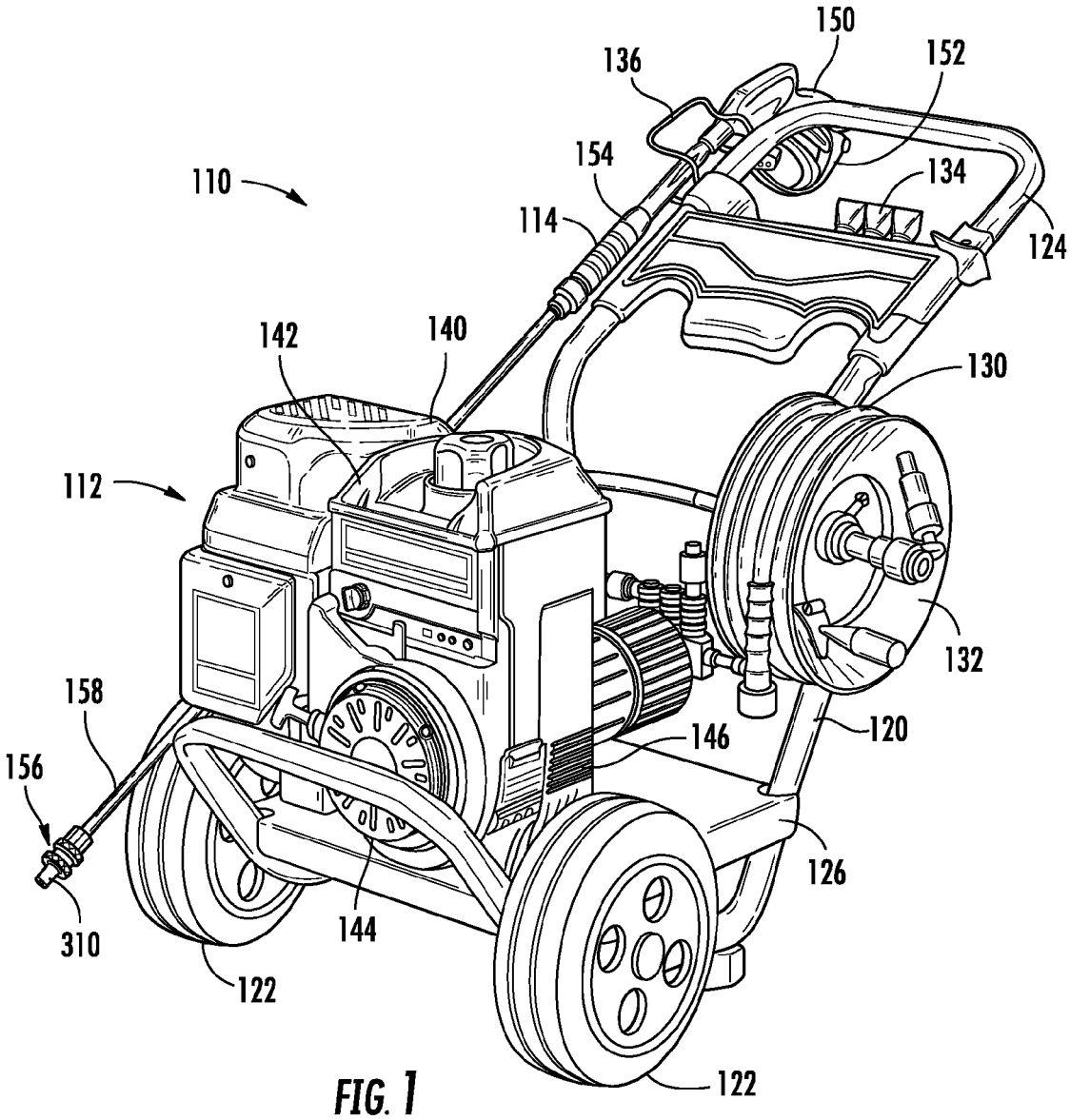
FIG. 1 is a perspective view of a pressure washer system according to an exemplary embodiment.

FIG. 1 shows a high pressure cleaning machine, such as a portable pressure washer system 110, according to an exemplary embodiment. The system 110 includes a motorized water pump 112, a spray gun 114, and a support structure 120. A user can wheel the system 110 to a work area, attach the spray gun 114 to the pump 112 and the pump 112 to a water source, and then actuate the pump 112. This system can be used for a wide spectrum of pressure washing applications. While FIG. 1 shows a pressure washer system, other embodiments of the invention span a broad range of applications, including water fountains and displays, in-home faucets, toy water guns, drinking fountains, and other applications.

The pressure washer system 110 includes the motorized water pump 112, wherein the pump is powered by a horizontally-mounted (or vertically) combustion (or electric) engine 140, including a fuel tank 142, a recoil starter 144, a crank case 146, and other engine components. As such, a crank shaft mechanically powers the motorized water pump 112, which may be in the form of a centrifugal pump, rotary pump, peristaltic pump, or other positive displacement or rotodynamic-type pump, and which may include additional gearing to transfer power from the crank shaft to the pump. The motorized water pump 112 drives (e.g., adds work energy to) a water flow, increasing water pressure, flow rate, flow velocity, temperature, or other characteristics of the water flow. In other embodiments, engine 140 includes an automatic starter. In still other embodiments, the pump 112 is powered by an electric motor receiving electricity from an outlet or battery.

Exemplary embodiment pressure washers are designed (i.e., rated) for production of a maximum pressure and flow rate. The maximum pressure rating for the pressure washer system 110 ranges from about 80 psi (e.g., for "garden hose booster washers") to about 6000 psi (e.g., for very heavy duty pressure washers), with a preferred range from about 100 to 4500 psi. The maximum flow rate ratings for the pressure washer system 110 ranges from about 0.5 to 8 gpm, with a preferred range from about 1 to 6 gpm, and more preferred range from about 2 to 5 gpm (e.g., 2.2 gpm).

Referring to FIG. 1, the support structure 120 of the pressure washer system 110 is a portable support base, having wheels 122, a handlebar 124, and a support base 126. A hose 130, a hose reel 132, controls 134, and a spray gun holder 136 are also coupled to the support structure 120. The controls 134 may be used to control and adjust the engine 140. The system 110 has a center of mass positioned such that a user can vertically lift the handlebar 124 to pivot the system 110 about the wheels 122, so that the system can be rolled to a desired location. In other portable pressure washer system embodiments, the pressure washer has a smaller motorized pump that can be strapped to a user, much like a back pack. In still other embodiments, the pressure washer may be carried to a desired location, much like a tool box or brief case. Other embodiments have three or four wheels, thinner tires, wider tires, treads, sleds, skis, or other transportation-assisting components. Still other pressure washer systems are not portable, but are still within the scope of the invention.

Still referring to FIG. 1, the spray gun 114 may be stored on the support structure 120 in the holder 136. The spray gun 114 includes a handle 150 with a trigger 152, an elongate shaft 154 with an extension 158, a coupling 156, and a nozzle assembly 310 (see also FIG. 3) coupled to an end of the extension 158 (see also FIG. 2E). The spray gun 114 can be coupled to the motorized pump 112 by a hose or other piping able to withstand the maximum pressure rating of the pressure washer. In some embodiments, the hose may connect to the spray gun 114 at the base of the handle 150, while in other embodiments, the hose may connect to the spray gun 114 at the back of the gun 114 above the handle 150. A garden hose 130 may be used to couple the motorized water pump 112 to a water source, such as a faucet, bibcock, sillcock, and the like.

Figure 2A:
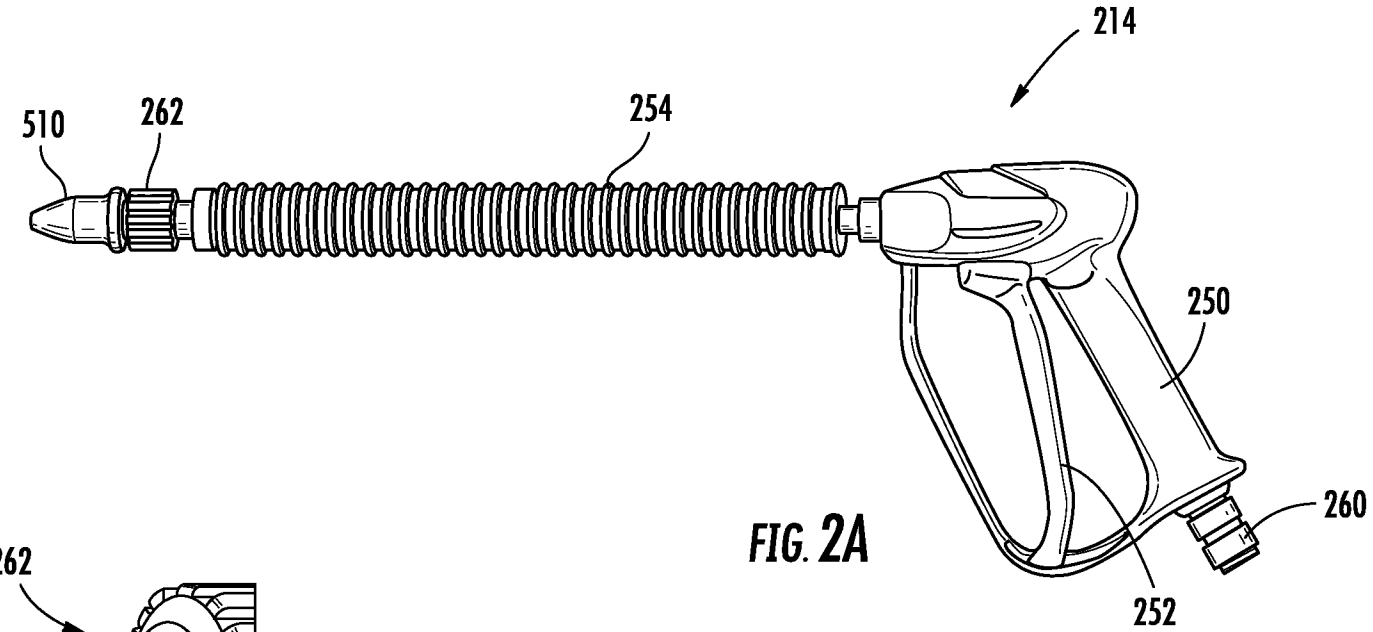
FIG. 2A is a side view of a pressure washer spray gun according to another exemplary embodiment.
Figure 2B:
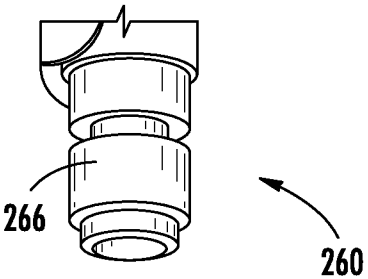
FIG. 2B is a perspective view of an inlet fastening end for the pressure washer spray gun of FIG. 2A according to an exemplary embodiment.
Figure 2C:
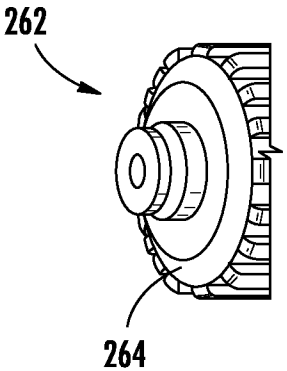
FIG. 2C is a perspective view of an outlet fastening end for the pressure washer spray gun of FIG. 2A according to an exemplary embodiment.

FIG. 2A shows a spray gun 214, according to an exemplary embodiment. The spray gun 214 includes a handle 250, a trigger 252, a shaft 254, and a nozzle assembly 510 (see also FIG. 5). The trigger is biased in a forward position, but may be pulled by a user toward the handle 250 at the rear of the gun 214. In some embodiments, the trigger is coupled to a valve within the gun 214, such that pulling the trigger releases the valve, either partially or fully. Some valve types to which the trigger 252 may be coupled include poppet valves, sliding sleeve valves, butterfly valves, ball valves, and other valves configured to withstand the maximum pressure rating of a corresponding pressure washer. Additionally, the spray gun 214 includes an inlet 260 (as shown in FIG. 2B) and an outlet 262 (as shown in FIG. 2C). As with the spray gun 114 of FIG. 1, the spray gun 214 of FIG. 2A may further couple at the shaft 254 to a nozzle body (not shown in FIG. 2A) or a shaft extension. In other embodiments, the nozzle body may couple directly to or be integrally formed with the outlet 262. Other embodiments include other forms of spray guns, such as a spray wand, where the trigger is a twisting section of the shaft, such that twisting the shaft opens or closes the valve. Another embodiment is of a fire-fighting hose spray nozzle, where the nozzle is opened by pulling back a valve control bar. Still other embodiments include spray guns having multiple exit orifice patterns (e.g., an elongate oval, two holes, a plurality of holes, an orifice with an adjustable cross-section, and other patterns), whereby different spray configurations are formed.

Figure 2D:
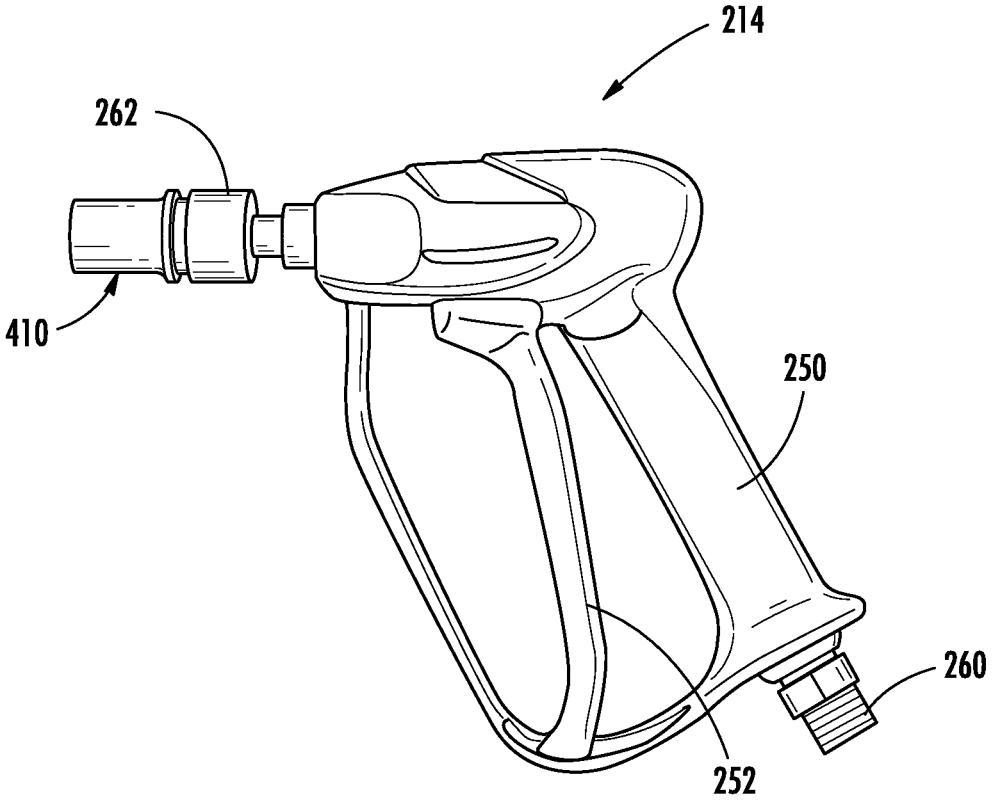
FIG. 2D is a side view of a pressure washer spray gun according to yet another exemplary embodiment.
Figure 2E:
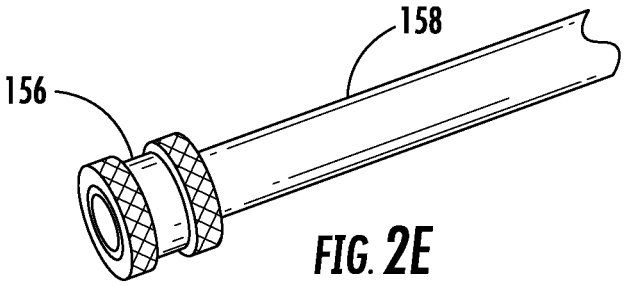
FIG. 2E is a side view of a pressure washer spray gun according to yet another exemplary embodiment.
Figure 2F:
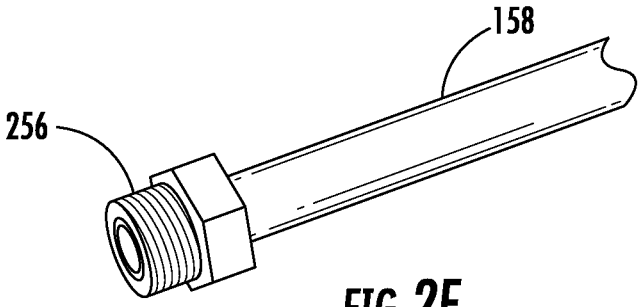
FIG. 2F is a side view of a pressure washer spray gun according to yet another exemplary embodiment.

The inlet 260 and the outlet 262 shown in FIGS. 2B and 2C are examples of fastening ends, where each of the ends includes one mating portion of a fastener. For example, the outlet 262 includes a female threaded fitting 264 and the inlet 260 includes a quick connect fitting 266. Other embodiments include fastening ends having male threaded fittings, twist-lock fittings, snapping fittings, and other fastening types. Between the inlet 260 and the outlet 262 is a water duct, channel, piping, etc., forming a flow path through the spray gun 214. Referring to FIG. 2D, another spray gun 214 is shown, having the handle 250, the trigger 252, the inlet 260, and a nozzle assembly 410 (see also FIG. 4), where the spray gun 214 does not include an extended shaft, and the outlet 262 is attached to the housing. Referring to FIGS. 2E and 2F, alternate embodiments are shown for shaft extensions 158 (or wand extensions), where the extensions 158 are configured to attach to a nozzle assembly on coupling ends 256, 257. The coupling end 256 of FIG. 2E is configured to attach to a quick connect nozzle assembly, while the coupling end 257 of FIG. 2F is configured to attach to a female threaded nozzle assembly.

Figure 3A:
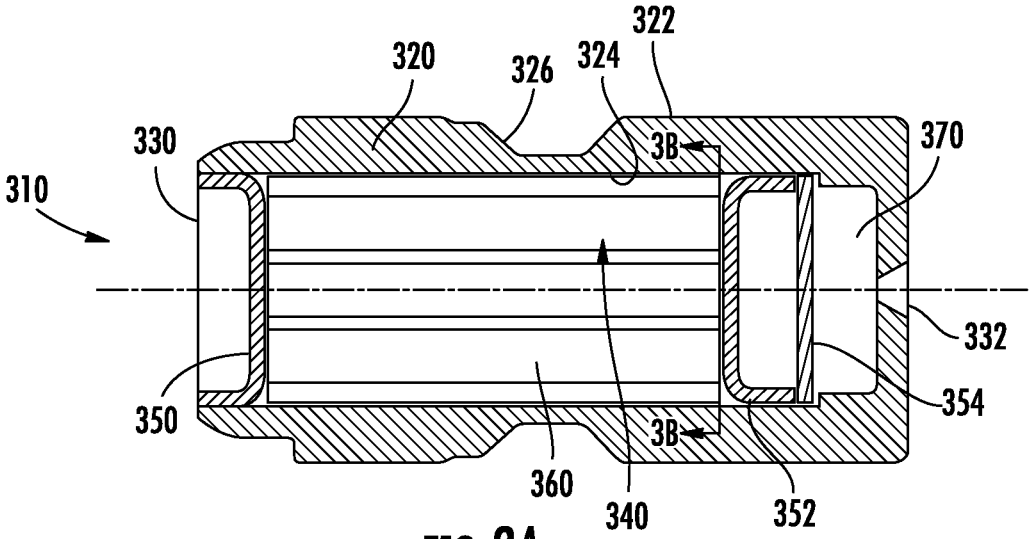
FIG. 3A is a side cross-sectional view of a nozzle assembly according to an exemplary embodiment.

FIG. 3A shows a cross-sectional view of the nozzle assembly 310, where the nozzle assembly 310 includes a nozzle body 320, having an outer surface 322, an inner surface 324, and a fastening feature, such as quick-connect recesses 326. The fastening feature is configured to couple the nozzle assembly 310 to the coupling structures 156, 256, 257, 262 shown in FIGS. 1-2, as like structures. The nozzle assembly 310 is shown as attached to the coupling 156 (see FIG. 1). The nozzle assembly 310 also includes an inlet 330 and an outlet 332, where the outlet 332 is a diverging orifice aligned with the center of the flow path through the nozzle assembly 310. Additionally, the nozzle assembly 310 includes a turbulence control member, shown as a turbulence control member 340 in FIG. 3A.

A flow of a fluid, such as water, can be characterized as laminar, turbulent, or within a spectrum of transition between laminar and turbulent flow, for example, where a portion of the flow is laminar while another portion is turbulent. One way to quantify the turbulence of a flow is with the Reynolds number, where a higher Reynolds number corresponds to a more turbulent flow. For example, in some pressure washer embodiments employing the turbulence control member 340, an exiting water stream may have a flow turbulence corresponding to a Reynolds number of less than about 4000 (dimensionless), with a preferred Reynolds number of less than about 2300. In other embodiments employing a turbulence control member, the Reynolds number is decreased as a result of the turbulence control member, but still exceeds 4000 upon exit.

Figure 3B:
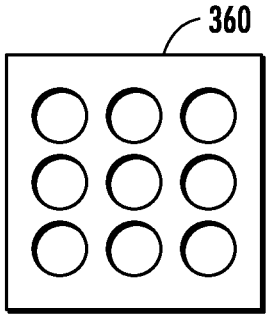
FIG. 3B is a front view of an array of conduits for the nozzle assembly of FIG. 3A.
Figure 3C:
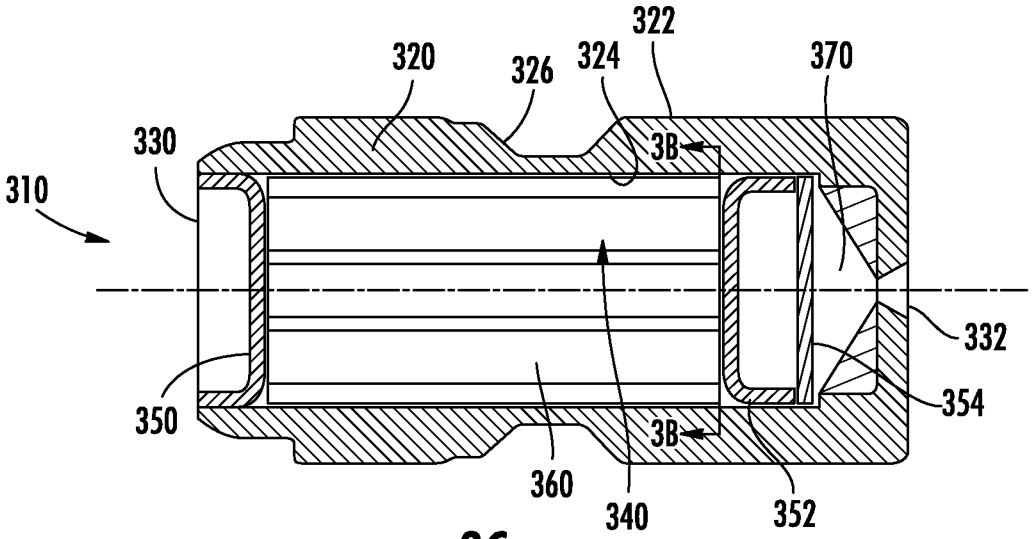
FIG. 3C is a side cross-sectional view of a nozzle assembly according to another exemplary embodiment.

The turbulence control member 340 of the nozzle assembly 310 includes several components. Referring to FIG. 3A, the turbulence control member 340 includes a screen 350 positioned along the flow path proximate to the inlet 330. Additional screens 352, 354 are also positioned in the flow path, but closer to the outlet. In some embodiments, the screens 350, 352, and 354 function as flow diffusers, redirecting the flow and breaking up eddies in a turbulent flow, for example. In other embodiments, the screens 350, 352, and 354 remove and collapse air bubbles and other voids in a turbulent flow. The turbulence control member 340 further includes a plurality of conduits 360, such as an array of elongate, tubular bodies, as also shown in FIG. 3B from a front view. In some embodiments the plurality of conduits 360 form a symmetric array of uniformly sized and shaped tubes. The screens 352, 354 located closer to the outlet 332 are located within a chamber 370 formed between the nozzle body 320, the outlet 332, and an end of the plurality of conduits 360. Individual streams exiting the plurality of conduits 360 may be joined together in the chamber 370 before exiting through the outlet orifice 332, where the chamber 370 in FIG. 3A has a substantially rectangular cross section, while the chamber 370 in FIG. 3C includes a converging cross section. In some embodiments, turbulence control members may include either fewer or more components than the turbulence control member 340, such as a member including a plurality of conduits without screens, a screen or series of screens without a plurality of conduits, or other arrangements for controlling and reducing turbulence in a water flow.

The turbulence control member may employ a broad range of tubular conduit structures. In some embodiments, a plurality of conduits form an array that is asymmetrical along certain axes. For example, the array may be asymmetric to optimize the efficiency of controlling turbulence for a flow traveling around a curve. In some embodiments, the conduits 360 vary in length and width relative to each other. According to various exemplary embodiments, the number of individual conduits can range from two to 1000, preferably from four to fifty, and more preferably from five to fifteen. According to certain alternative embodiments, the conduits 360 are not cylindrical or circular in cross section, but instead are rectangular, hexagonal, oval, and other geometries. Some embodiments include conduits of different shapes arrayed together in a group. In some embodiments, the cross section of an individual conduit may vary as a function along the length of the conduit, such as a tapering conduit, or an expanding then contracting conduit. In still other embodiments, the conduits 360 are not straight, but instead have a curvature. For example, some conduits may be arranged much like individual strands in a composite rope, braid, or similar structure, where the curvature provides a controlled vorticity to the flow.

The conduit length and width of the conduits 360 are optimized to facilitate a desired Reynolds number in the exit stream for a given pressure washer having a particular maximum pressure and flow rate. A metric for quantifying the particular structure of a conduit is to compare the conduit length to its cross-sectional width. For conduits without circular cross sections, length may be compared to an average cross-sectional width. In some exemplary embodiments, the length of a conduit is greater than the average cross-sectional width; in a preferred embodiment, the length of a conduit is greater than two times the average cross-sectional width; and in a more preferred embodiment, the length of a conduit is greater than ten times the average cross-sectional width. For example, a conduit may have a length of twenty times the average cross-sectional width of the conduit.

The screens 352, 354 may have various configurations depending upon the embodiment. Some embodiments have screens 352, 354 of different sizes and mesh configurations placed in series along the water flow. Certain embodiments have screens 352, 354 positioned before, within, and after a plurality of conduits. Some embodiments have screens 352, 354 that intersect the entire flow path, while other embodiments have screens intersecting only a portion of the entire flow path. In some exemplary embodiments the screens are arranged in a C-shape or cup shape, where the base of the cup (or the back of the C-shape) is positioned in the flow path, and where the sides of the cup (or top and bottom of the C-shape) are positioned along the inside wall of the surrounding nozzle body. Screens 352, 354 may have square holes, circular holes, oval holes, rectangular holes, other shaped holes and holes formed from combinations of such shapes. Some screens may also function as filters.

Figure 4A:
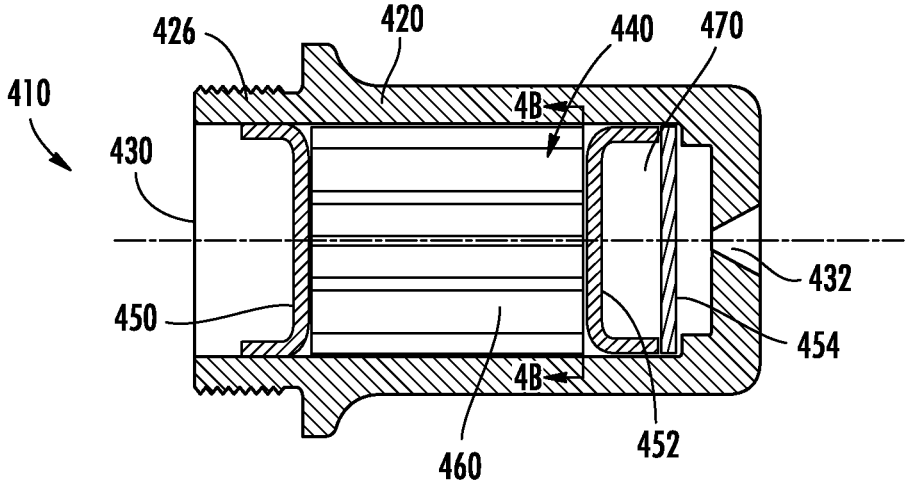
FIG. 4A is a side cross-sectional view of another nozzle assembly according to an exemplary embodiment.
Figure 4B:
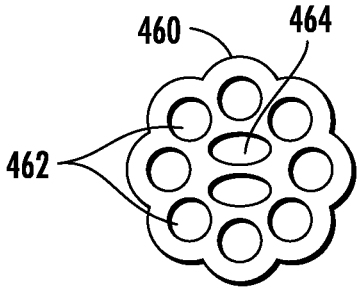
FIG. 4B is a front view of an array of conduits for the nozzle assembly of FIG. 4A.

FIG. 4A shows a cross-sectional side view of another embodiment of a nozzle assembly, shown as nozzle assembly 410, the assembly including a nozzle body 420 having an outer surface and an inner surface, and a fastening feature, such as a male threaded fitting 426. The fastening feature is configured to couple the nozzle assembly 410 to the coupling structures 156, 256, 257, 262 shown in FIGS. 1-2, as like structures. The nozzle assembly 410 further includes a turbulence control member 440 having a first screen 450 along the flow path, between an inlet 430 and an outlet 432; a plurality of conduits 460 along the flow path between the first screen 450 and a second screen 452; the second screen 452 accompanied by a third screen 454 between the second screen 452 and the outlet 432, also along the flow path. The exit orifice 432 (i.e., outlet) has a diverging cross-section. FIG. 4B is a front view showing the conduits 460, where eight cylindrical tubes 462 surround two tubes having oval cross sections 464. A process by which the turbulence control member 440 operates includes: providing a water flow through the inlet 430, passing the flow through a series of screens 450, 452, 454, passing the flow through the plurality of conduits 460 (dividing the flow into a plurality of streams), joining individual streams from the plurality of conduits 460 in a chamber 470, and then directing the flow through the diverging nozzle outlet orifice 432.

Figure 5A:
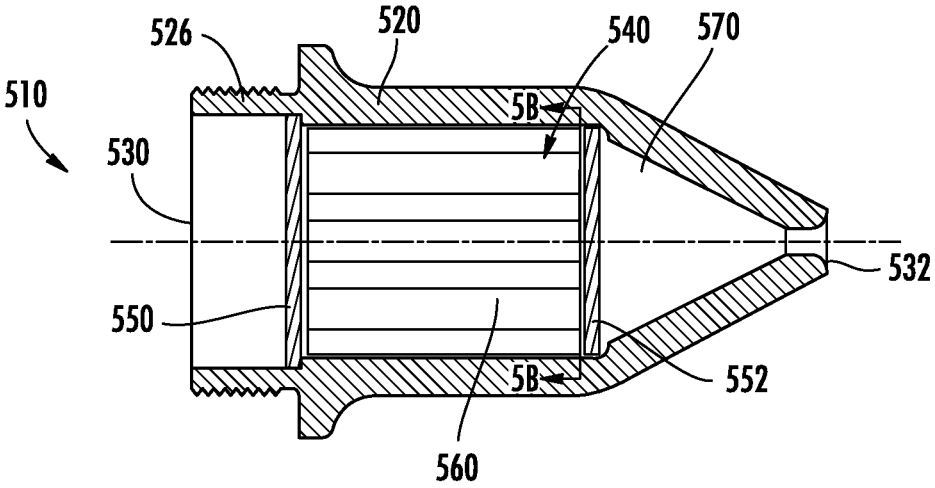
FIG. 5A is a side cross-sectional view of yet another nozzle assembly according to an exemplary embodiment.
Figure 5B:
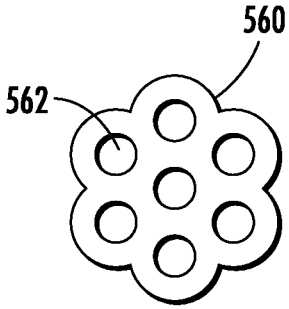
FIG. 5B is a front view of an array of conduits for the nozzle assembly of FIG. 5A.

FIG. 5A shows a cross-sectional side view of yet another embodiment of a nozzle assembly, shown as nozzle assembly 510, the assembly including a nozzle body 520 having an outer surface and an inner surface, and a fastening feature, such as a male threaded fitting 526. The fastening feature is configured to couple the nozzle assembly 510 to the coupling structures 156, 256, 257, 262 shown in FIGS. 1-2, as like structures. The nozzle assembly 510 further includes a turbulence control member 540 having a first screen 550 along the flow path, between an inlet 530 and an outlet 532; a plurality of conduits 560 along the flow path between the first screen 550 and a second screen 552 before the outlet 532, also along the flow path. The exit orifice 532 (i.e., outlet) has a constant cross-section, while a chamber 570 has a converging cross section. FIG. 5B is a front view showing the plurality of conduits 560, where seven cylindrical tubes 562 are in a honeycomb arrangement. A process by which the turbulence control member 540 operates includes: providing a water flow through the inlet 530, passing the flow through a series of screens 550, 552, passing the flow through the plurality of conduits 560 (dividing the flow into a plurality of streams), joining individual streams from the plurality of conduits 560 in the chamber 570, converging the flow in the chamber 570, and then directing the flow through the nozzle outlet orifice 432.

The turbulence control members (e.g., member 340, member 440, and member 540) may also be utilized with unassisted garden hose spray nozzles (i.e., without an auxiliary pump, typically at pressures below 100 psi). For example, the nozzle assemblies shown in FIGS. 3-5, can be attached to the end of a garden hose to reduce the turbulence in the output water flow.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "front," "back," etc.) are merely used to describe the orientation of various elements in the accompanying drawings. The orientation of various elements may differ according to other exemplary embodiments, and such variations are intended to be encompassed by the present disclosure.

The construction and arrangement of the pressure washer, spray gun, and nozzle assembly systems as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. In some embodiments, a turbulence control member may be positioned in a flow path before a water enters a pump (e.g., in addition to or instead of at the nozzle), because a reduced turbulence may increase pump efficiency. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A pressure washer spray gun for cleaning applications using a high-powered stream of water, comprising:

a housing comprising a handle;

a water duct coupled to the housing, the water duct forming a water flow path;

a trigger for operating a valve, the valve coupled to the water duct and positioned in the water flow path, wherein the trigger is configured to release the valve; and a nozzle body coupled to the water duct, the nozzle body comprising a first screen along the water flow path and a laminar flow body configured to be received into an inner chamber of the nozzle body, wherein the laminar flow body defines a plurality of elongated circular apertures arranged in parallel with each other and disposed along the water flow path such that within the laminar flow body, water travels only through the plurality of elongated circular apertures.

2. The spray gun claim 1, wherein the first screen is positioned along the water flow path before the laminar flow body.

3. The spray gun of claim 2, wherein the spray gun further comprises a second screen positioned along the water flow path after the laminar flow body.

4. The spray gun of claim 3, wherein the nozzle body further comprises an outlet having a divergent cross section.

5. A pressure washer spray gun for cleaning applications using a high-powered stream of water, comprising:

a housing comprising a handle;

a duct coupled to the housing, the duct forming a water flow path;

a trigger for operating a valve, the valve coupled to the duct and positioned in the water flow path, wherein the trigger is configured to release the valve; and a nozzle body coupled to the duct and comprising a laminar flow body configured to be received into an inner chamber of the nozzle body, wherein the laminar flow body defines a plurality of elongated circular apertures arranged in parallel with each other such that within the laminar flow body, water travels only through the plurality of elongated circular apertures, wherein the laminar flow body is configured to reduce the turbulence of a water stream flowing therethrough and wherein an outlet of the nozzle body has a divergent cross-section for output of the water stream.

6. The spray gun of claim 5, wherein the nozzle body further comprises a first screen positioned along the water flow path.

7. The spray gun of claim 6, wherein the nozzle body further includes a chamber positioned along the water flow path between the laminar flow body and the outlet of the nozzle body, wherein the chamber is configured to join water streams exiting the laminar flow body.

8. The spray gun of claim 7, wherein the first screen is positioned between an inlet for the nozzle body and the laminar flow body.

9. The spray gun of claim 8, wherein the nozzle body further comprises a second screen positioned along the water flow path between the laminar flow body and the outlet of the nozzle body.

10. The spray gun of claim 5, wherein the plurality of elongated circular apertures of the laminar flow body includes a first aperture having a stream path length and a stream cross-section with an average cross-sectional width, wherein the stream path length is at least twice the average cross-sectional width of the first aperture.

11. A pressure washer spray gun for cleaning applications using a high-powered stream of water, comprising:

a nozzle body configured to be coupled to a housing, wherein the nozzle body includes an outlet having a divergent cross-section;

a laminar flow body integrated with the nozzle body, wherein the laminar flow body defines an array of uniformly sized and shaped elongated circular apertures arranged in parallel with each other and disposed along a water flow path such that within the laminar flow body, water travels only through the array of uniformly sized and shaped elongated circular apertures;

a screen positioned in the nozzle body adjacent to the laminar flow body; and a fastening feature integrated with the nozzle body, wherein the fastening feature is configured to be received by at least one of a spray shaft extension and a housing of the spray gun such that the nozzle body is removably coupled.

12. The spray gun of claim 11, wherein the screen is positioned before the laminar flow body along the water flow path.

13. The spray gun of claim 12, wherein the screen is cup shaped and is positioned in the water flow path with sides positioned along an inside wall of the nozzle body.

14. The spray gun of claim 12, wherein the nozzle body further comprises a second screen positioned along the water flow path between the laminar flow body and the outlet of the nozzle body.

15. The spray gun of claim 11, further comprising a chamber formed in the nozzle body, wherein the chamber of the nozzle body has a convergent cross-section.

16. The spray gun of claim 1, wherein the nozzle body further comprises a fastening feature such that the nozzle body is removably coupled with the duct.

17. The spray gun of claim 16, wherein the fastening feature is at least one of a male connector and a female connector.

18. The spray gun of claim 17, wherein the fastening feature is a quick connect fitting.

19. The spray gun of claim 18, wherein the fastening feature is integrally formed with the nozzle body.

20. The spray gun of claim 1, wherein the plurality of elongated circular apertures are configured in a rectangular array and spaced at a specified distance relative to one another.

* * * * *